United States Patent [19]

Wilson

[11] 3,978,376

[45] Aug. 31, 1976

[54] ELECTRONIC LOCK

[76] Inventor: Larry E. Wilson, 703 W. Main Cross, Taylorville, Ill. 62568

[22] Filed: Sept. 5, 1973

[21] Appl. No.: 394,440

[52] U.S. Cl. ..... 317/134

[51] Int. Cl.[2] ..... E05B 49/00

[58] Field of Search ..... 317/134; 70/278; 307/10 AT, 10 R

[56] References Cited

UNITED STATES PATENTS 3,242,388 3/1966 Tellerman ..... 317/134

*Primary Examiner*—Harry Moose

[57] ABSTRACT

An electronic lock providing open/close commands to operate electrically controlled doors. Contacts operated in a predetermined sequence discharge and charge capacitors transfering charge along a capacitor chain to finally close an electronic switch. Contacts not part of the predetermined sequence briefly disable the lock when operated.

3 Claims, 1 Drawing Figure

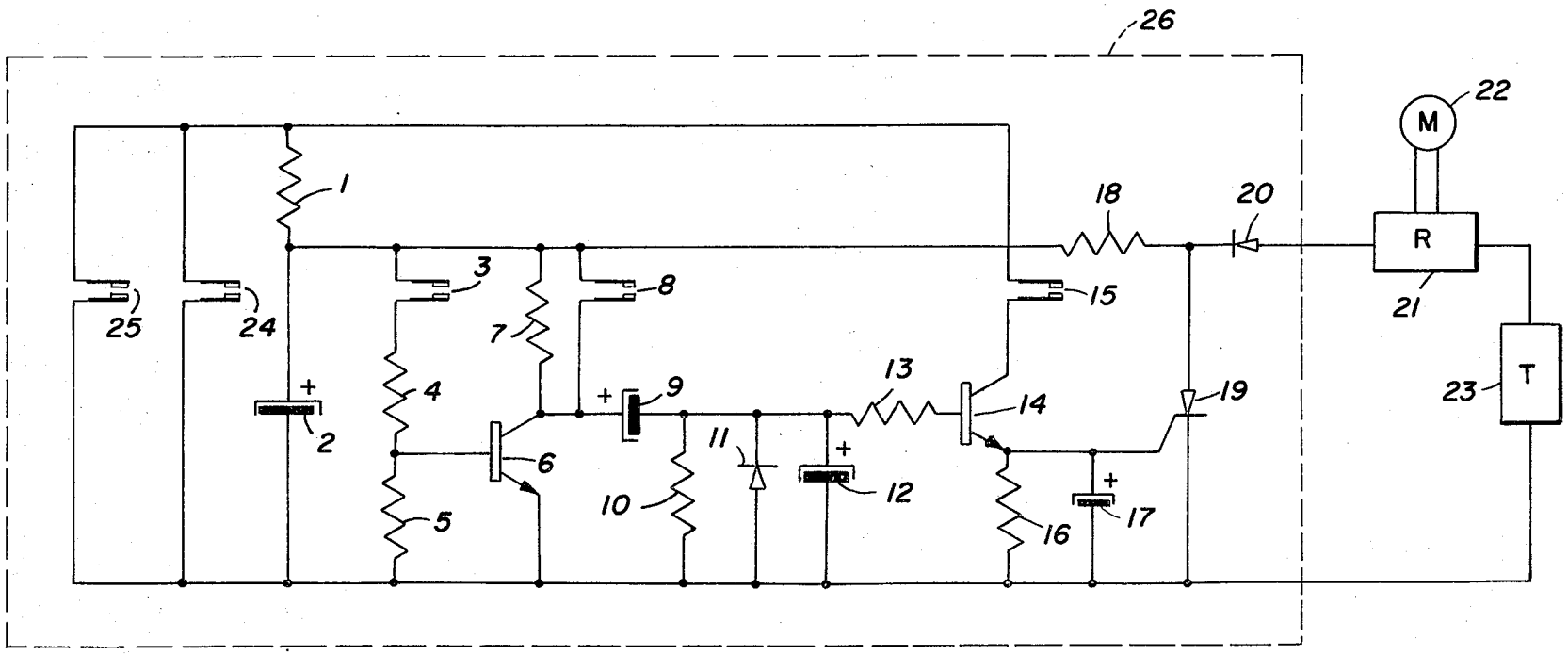
T
23
22
M
R
21
20
19
26
18
15
17
16
14
13
12
11
10
9
8
7
6
3
4
5
1
2
24
25

ELECTRONIC LOCK

BACKGROUND OF THE INVENTION

With the proliferation of electrically operated and controlled door systems has come the need for a low cost, easily installed, secure electric lock system.

For a specific instance, many garage doors are electrically operated, with the open/close commands coming from an attached radio control receiver, or a simple push button switch. These control devices provide control from, for instance, inside an automobile, or from inside the garage. Typically, no control is provided outside the garage. It is thus not possible to open the door from the outside of the garage. A push button similar to the one used for the inside control, of course, could be provided. The push button, however, gives access to anyone pressing it, and affords no physical security whatsoever. A properly designed key operated switch performs both of the functions of control and access limitation, but requires the operator to carry the proper key on their person, which is quite inconvenient. A combination lock, specifically an electronic combination lock, provides "keyless" control along with very high physical security. The basic objection to a full feature electronic lock in the past has been the system cost, installation cost and difficulty of installation.

SUMMARY OF THE INVENTION

Objects of the present invention are to provide a secure, low cost electronic lock, which is installed and connected as easily as the push button it replaces.

The lock is of the charge transfer type wherein depressing the first key of the combination discharges a previously charged capacitor. The second key transfers charge to a second capacitor, "arming" the output switch for a short period of time. The third key activates the output switch if the first two keys were pressed in proper sequence.

Depression of an incorrect key effects discharge of the power supply capacitor preventing operation of the lock until the capacitor has recharged. The combination of a short time period in which the lock may be activated after depression of the first key in the combination sequence, and a long disable time wrong combinations, along with at least a three digit combination provides very high physical security. Several hours would be required to "pick" the lock by trying all possible combinations.

DESCRIPTION OF THE DRAWING

FIG. 1 is an essentially schematic diagram showing one form of the circuitry of the low cost electronic lock.

DESCRIPTION OF THE PREFERRED EMBODIMENTS

FIG. 1 illustrates in schematic form the low cost electronic lock 26. The lock device comprises capacitor 9 which is normally charged to the full supply voltage through resistors 7 and 10, and capacitor 12 which is normally uncharged or at zero potential. Resistor 10 insures the complete discharge of a capacitor 12. Contact 3 is the first of the lock opening sequence. Closure of contact 3 causes transistor 6 to conduct, discharging capacitor 9. Diode 11 prevents capacitor 12 from acquiring a negative charge as capacitor 9 is discharged. When contact 3 is opened capacitors 9 and 12 both charge through resistor 7. Capacitor 9 will eventually charge to the supply voltage. Capacitor 12, however, will not be appreciably charged as the discharge time of capacitor 12 through resistor 10 is much less than the charge time of capacitor 9 through resistor 7. Closure of contact 8 during the said charging interval provides a much lower impedance charging path than through resistor 7 and both capacitors 9 and 12 will be rapidly charged according to the power supply voltage, the instantaneous voltage on capacitor 9 at the time of closure of contact 8, and the capacitance ratio of the said capacitors.

Transistor 14 is now supplied base current by capacitor 12 and resistor 13 and is in the conducting state. With contact 15 open only base current flows through resistor 16 and hence only a small voltage is developed across resistor 16. Closure of contact 15 allows said base current in resistor 16 to be multiplied by the current gain of transistor 14 hence increasing voltage across resistor 16 sufficiently to trigger electronic switch 19. Electronic switch 19 completes the circuit causing relay 21 to be activated starting the open/close cycle of the door as symbolized by motor 22.

When capacitor 9 is fully charged as during standby, closure of contact 8 has no effect. Closure of contacts 3, 8, and 15 simultaneously will not operate the lock. Contact 3 must be closed first to effect discharge of capacitor 9. It is only during the charging of capacitor 9 that charge can be transfered to capacitor 12, and to charge, capacitor 9 must first be discharged.

Transformer 23 acts as the ac power supply for the door controls, relay 21, and electronic lock 26. In standby operation lock 26 draws only a small amount of current through relay 21. This small current is insufficient to cause activation of relay 21.

Closure of any contact not associated with the correct code sequence, such as contacts 24 and/or 25, causes discharge of power supply filter capacitor 2. The lock is at this time insufficiently powered to respond to even the proper code sequence. Capacitor 2 is charged by resistor 18 but the lock will remain inoperative until a predetermined voltage threshold is passed at which time the correct switch closure sequence will again operate the lock. The more incorrect switch closures that are made in any given time interval, the more deeply capacitor 2 will be discharged and the longer will be the charge time to restore proper function.

Resistor 1 is indicative of the wide tolerance the lock has for contact resistance. Resistor 1 can be on the order of zero to several thousand ohms without affecting lock operation.

I claim:

1. An electronic lock system comprising a voltage source, and electrically responsive locking device, an electrically responsive shorting device, said voltage source, locking device, and shorting device connected in series with each other, first and second capacitors connected in series with each other and in parallel with said shorting device, means for maintaining said first capacitor normally charged and said second capacitor normally discharged, first normally open momentarily actuatable contact means connected to said first capacitor for discharging said first capacitor, second normally open momentarily actuatable contact means connected to said first and second capacitors for charging said second capacitor through said first capacitor subsequent to the discharge of said first capacitor by said first contact means, and third normally open momentarily actuatable contact means connected to said shorting device for operating said shorting device in cooperation with the charge on said second capacitor, whereby closure of said first, second and third contact means in sequence operates said shorting device thereby operating said locking device.

2. An electronic lock system according to claim 1 and further comprising a third capacitor connected in parallel with said shorting device, said third capacitor being charged from said voltage source thereby providing charging current for said first and second capacitors through said second contact means, and a plurality of normally open momentarily actuatable contact means connected in parallel with said third capacitor, whereby closure of any of the said plurality of contact means discharges said third capacitor thereby disabling said lock system.

3. An electronic lock system according to claim 1 wherein said shorting device comprises an electronic switch having a control electrode, and said third contact means comprises a transistor having emitter, base, and collector electrodes and a manually operable normally open momentarily actuatable switch means, said switch means being connected in series with the emitter-collector path of said transistor, the series circuit thus formed being connected in parallel with said electronic switch with the emitter of said transistor connected to said control electrode of said electronic switch and the base electrode of said transistor connected in series with a resistor to the junction point of said first and second capacitors.

* * * * *